US006112693A

United States Patent [19]

Addison

[11] Patent Number: 6,112,693

[45] Date of Patent: Sep. 5, 2000

[54] KAYAK SEAT

[76] Inventor: Corran Addison, 100 Ave. de la Marquise, Beauport, Quebec, Canada, G1E 1S7

[21] Appl. No.: 09/304,455

[22] Filed: May 3, 1999

[51] Int. Cl.[7] ..... B63B 35/71

[52] U.S. Cl. ..... 114/347; 114/363

[58] Field of Search ..... 440/104, 105; 114/347, 363

[56] References Cited

U.S. PATENT DOCUMENTS 5,042,416 8/1991 Arcouette ..... 114/347

5,899,780 5/1999 Robbins ..... 440/105

*Primary Examiner*—Ed Swinehart

*Attorney, Agent, or Firm*—Swabey Ogilvy Renault; Guy J. Houle

[57] ABSTRACT

A height adjustment mechanism is provided for a seat of a kayak whereby to position the seat at a desired elevation above a waterline of the kayak, as determined when on a body of water. The kayak is comprised of a hull section and a deck section provided with an opening to accommodate a user person. The seat is positioned in the opening and secured on an inner wall of the hull section. The adjustment means may be constituted by various mechanisms or elements.

10 Claims, 3 Drawing Sheets

KAYAK SEAT

TECHNICAL FIELD

The present invention relates to an adjustable seat for a kayak to give its user greater control and visibility.

The seat system of the present invention gives the user of a whitewater or surf kayak greater control and visibility, without the usual disadvantages of current seats in such water crafts. The invention allows the user to apply more pressure with less energy to the sides of the kayak and adds greater control over the elevation and submersion of the ends of the kayak.

BACKGROUND ART

Whitewater and surf crafts are currently broken down into two classes. Each have their advantages and disadvantages. These are described by the International Canoe Federation (the International Government body for canoe and kayak sports) as a Kayak (K1) and a Canoe (C1). Canoes are again divided into two classes. Open and decked (closed). Our focus is on that of the decked canoe, or as it is commonly called, a C1.

The kayak requires the participant to sit with the legs outstretched in front. The paddler uses a double bladed paddle that allows equal control from both sides of the craft. The position is natural, and comfortable, and the double bladed paddle eliminates the 'off side' that occurs when only a single bladed paddle is used, as it can only be used effectively on one side of the craft. The seated position on the bottom of the kayak (or close to it) with the legs outstretched is necessary for both comfort, and the execution of a technique used after a capsize to right the craft called the 'Eskimo Role'. However, because the paddler sits on a seat that is located just above the bottom of the kayak (about or just below the water-line of the kayak) minimal (restricted) use can be made of the paddler's weight to influence the forward/backward pitch, or sideways tilt of the kayak. This control over the ends and sides of the kayak is desirable to facilitate the ease and effectiveness of whitewater paddling.

The C1 class requires the paddler to sit in a kneeling position, with the feet under the buttox, which rests on a raised pedestal. The paddler uses a single bladed paddle to guide and control the craft. The raised position of the paddler provides a superior view of the rapids and its obstacles, and greater control over the forward/backward pitch, or sideways tilt of the craft. This allows the paddler to move the edges (sides) more effectively out of, or into, the river currents depending on the desired reaction or performance, and to either raise the ends, or submerge them, as desired, with greater ease and precision. The seating position is, however, very uncomfortable, and is a serious sacrifice given the return in control. In addition, the 'Eskimo Role' from this position is extremely difficult with a kayak paddle, and so a single bladed paddle is used. While the overall effect of the raised seat position, with the knees contacting the bottom of the boat, offers superior control on the side that the paddler generally controls his boat from (the on-side), control on the opposite side of the craft (off side) is extremely difficult. The single bladed paddle requires the paddler to reach around and across the boat to get the blade into the water on the other side. This leaves the paddler in a very twisted, limiting and vulnerable position, and is the single biggest disadvantage of the system. In addition to this, correct outfitting of the boat to minimize paddler movement (which increases boat control) can be very restricting to quick exit in the event of an emergency, and this presents many safety concerns.

SUMMARY OF INVENTION

The present invention effectively combines the advantages of the two, and eliminates the disadvantages of both. I have maintained the seated position of the kayak with the legs outstretched, keeping the comfort of a kayak, but raised the seat to a height that gives the paddler the same control over the ends and the sides as the C1 class crafts. The seated position allows the paddler to continue to use a double bladed paddle, eliminating the 'off-side' of the C1 class, maintaining all the control that the kayak paddle offers, and the control that the raised seating position of the C1 class offers. The seat has been raised so that it sits above the waterline of the boat, while the heels of the feet remain in contact with the hull, around or below the waterline. This allows the paddler not only the ability to have greater force to manipulate the sides and ends of the kayak as described above, but also keeps contact with the hull as the knees would in a C1 class, for better transfer of energy. Angling the feet down (out and below the same horizontal plane as the seat) provides even greater torque than would be available were they to remain as raised, or close to, the same plane as the seat.

Generally speaking, the seat and heel position in a whitewater kayak sit at approximately the same height—level—(horizontal), but not exactly. The heels are almost always slightly lower than the seat by default as they rest on the floor of the boat, while the seat is suspended anywhere from ¼ inch to 1 inch (on average) off the bottom. However, it is the extent of the differences between the two, combined with the significant increase in height of the seat itself above the waterline that the important factor is achieved.

According to a broad aspect of the present invention, there is therefore provided a kayak which comprises a hull section and a deck section. An opening is formed in the deck section to accommodate a user person. A seat is positioned in the opening and secured on an inner wall of the hull section. A height adjustment means is provided to position a seating surface of the seat at a desired elevation above a waterline of the kayak as determined when on a body of water.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
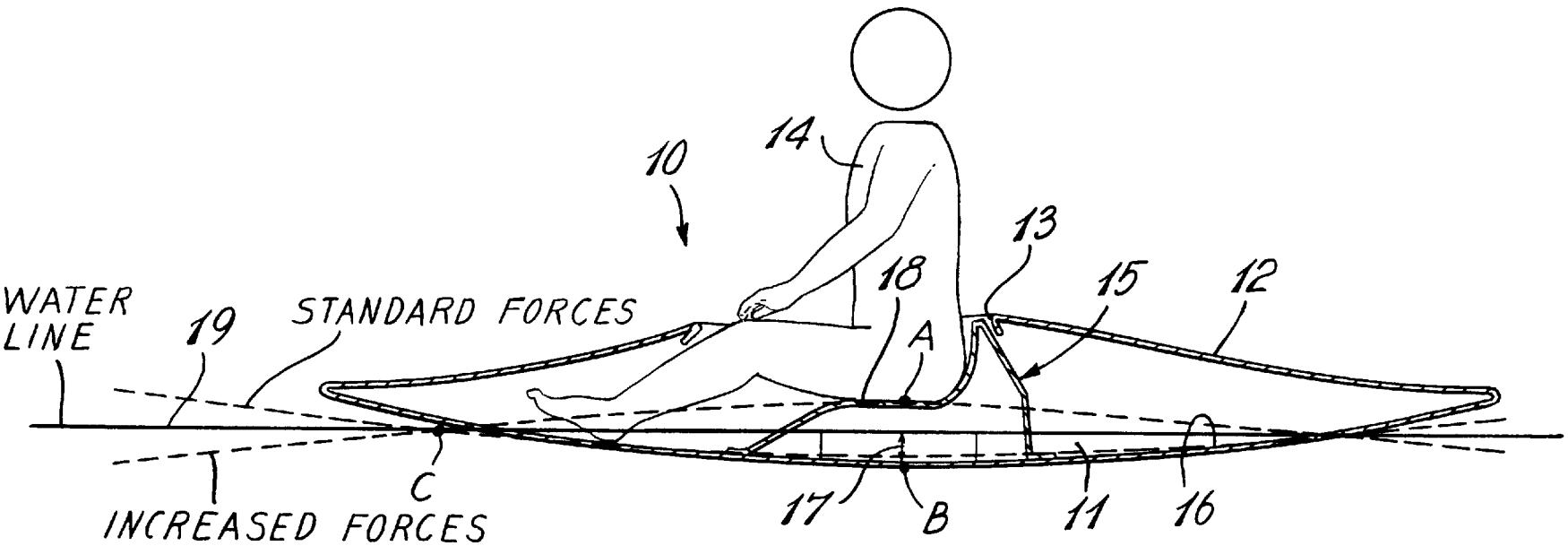
FIG. 1 is a sectional side view of a water craft having an adjustable elevated seat, the seating plane of which is disposed spaced above the waterline of the craft with the weight of its user.

Referring now to the drawings, and more particularly to FIG. 1, there is shown at 10 a kayak constructed in accordance with the invention and comprised essentially of a hull section 11 and a deck section 12. An opening 13 is formed in the deck section to accommodate a user person 14.

A seat 15 is positioned through the opening 13 and secured on an inner wall 16 of the hull section 11. A height adjustment means 17 interconnects the seat 15 to the inner surface 16 of the hull or the sides 20 of the deck section to position a seating surface 18 of the seat 15 at a desired elevation, herein represented by point A, above the waterline 19 of the kayak as determined when on a body of water.

Figure 4:
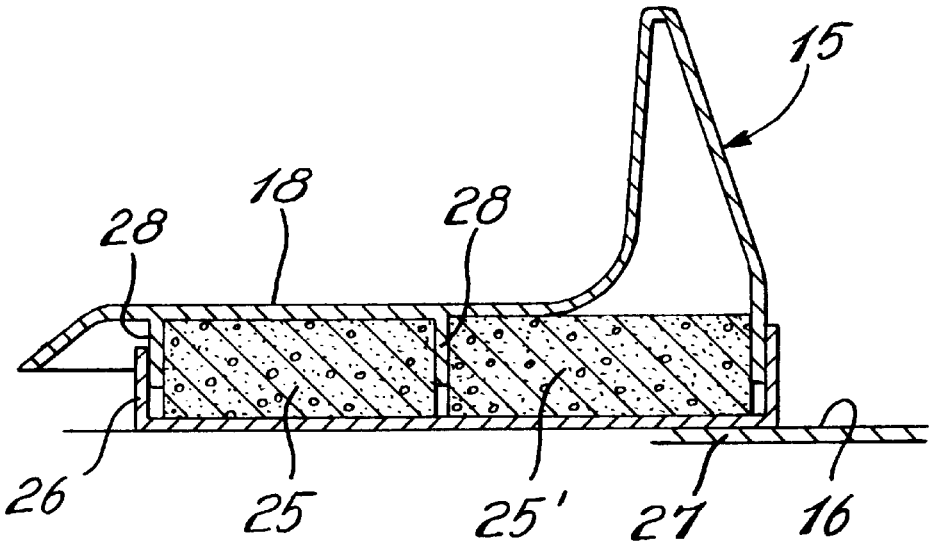
FIG. 4 is a fragmented section view illustrating one example of the height adjustment means.
Figure 5:
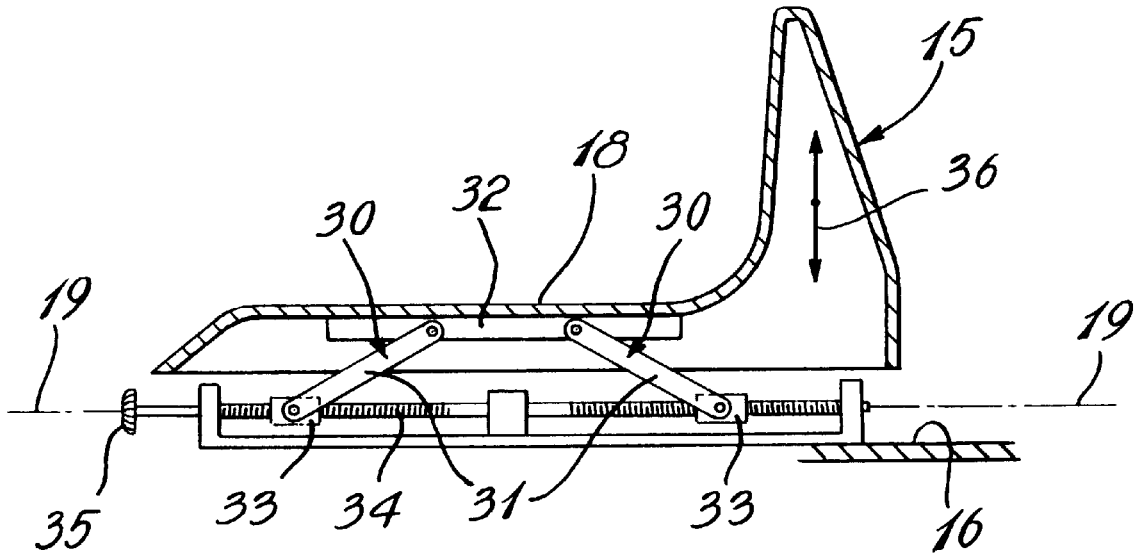
FIG. 5 is a view similar to FIG. 4, illustrating a still further example of the height adjustment means.

The height adjustment means 17 is a variable height adjustment means and may be constituted by various means, a few of which are illustrated in FIGS. 4 and 5 and which will be described later.

Figure 2:
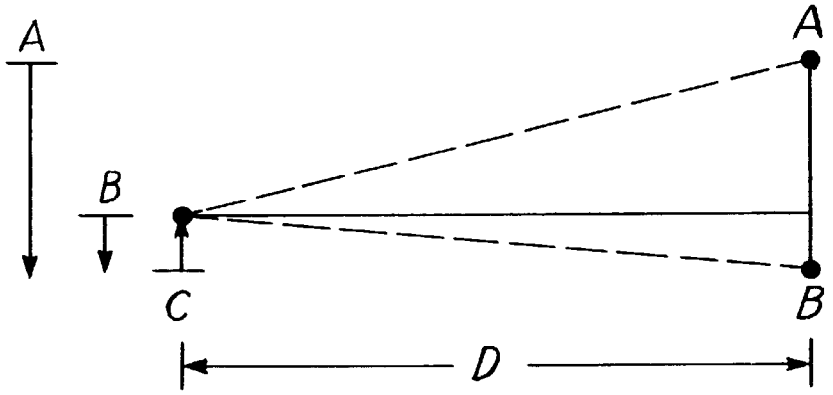
FIG. 2 is a diagram explaining the invention.
Figure 3:
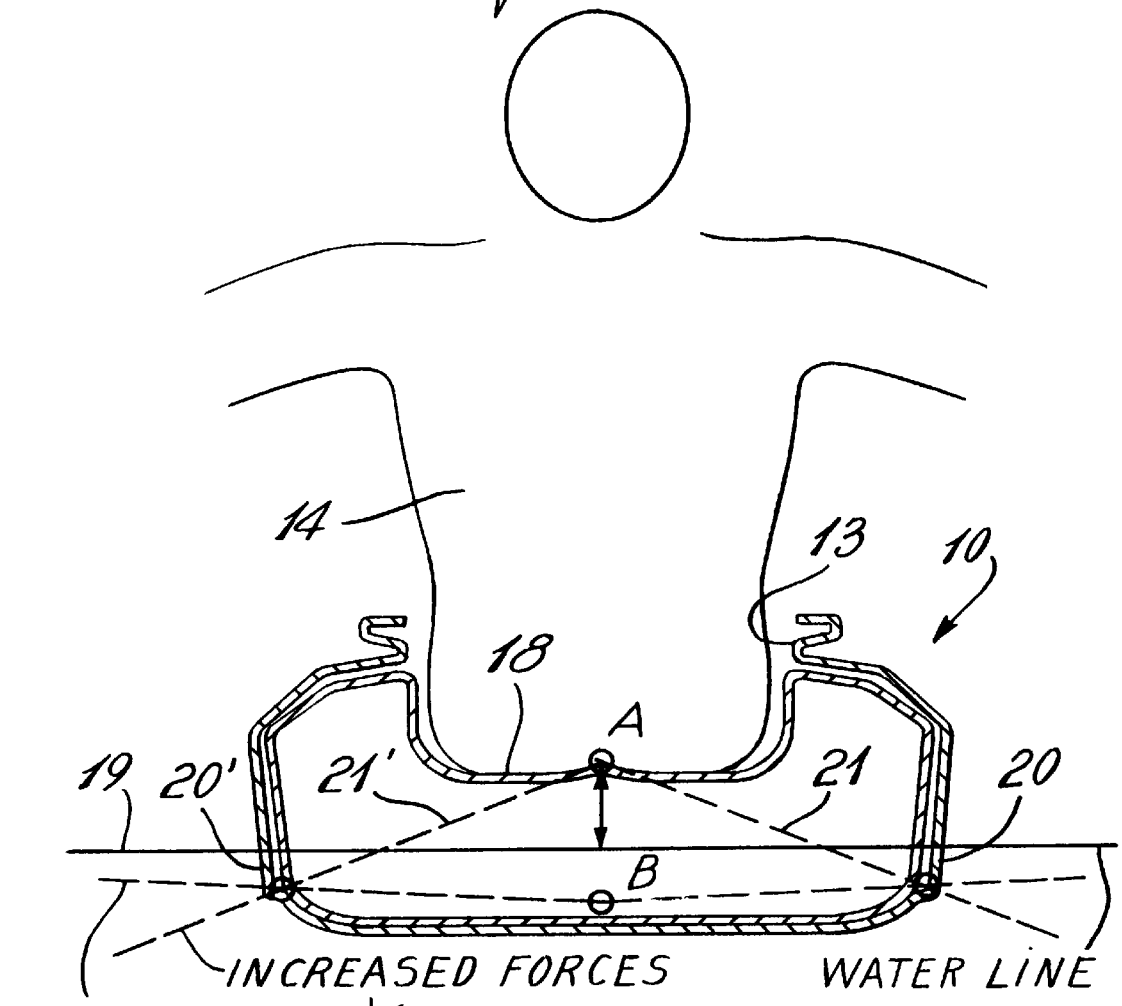
FIG. 3 is a sectional end view showing the elevated seat.

With reference now to FIG. 2, there is illustrated a graph to explain the effectiveness of the present invention using the laws of physics governing the sum total of the forces on a point of rotation and this graph is described with reference to FIG. 1 wherein points A, B and C as shown on the graph are illustrated at different positions of the kayak and its seat. As shown in FIG. 2, the letter A represents the seated position according to the present invention which is the seating surface. Letter B represents a paddler's standard seated position without the present invention wherein the paddler sits at the bottom of the kayak with his legs extended outwardly, as previously described. Letter C is a constant force exerted upwards by the water at the inner section with the waterline. Letter D represents a constant length from point A on the seating surface to point C on the kayak. It is pointed out that when the kayak is flat the force B equals the force C. As an example only, the distance of point A from the waterline as compared to the distance of point B may be in the vicinity of 4 times the height of point B from the waterline. Accordingly, because point A is elevated approximately 4 times above the waterline, it would require one-quarter less the force of the user person to manipulate the sides and ends of the kayak and this is illustrated in FIG. 3 where the vectors 21 and 21' show the force applied to the sides 20 and 20' of the kayak 10. As clearly illustrated, the seating surface 18 is above the waterline 19. As also shown in FIG. 3, if the user person 14 was seated on point B, as is the case with prior art kayaks, and below the waterline, this force is quite inferior, and as above-stated, depending on the position of the seating surface 18, it could require forces 4 times greater than that required if seated elevated at point A.

With reference now to FIG. 4, there is shown one embodiment of the height adjustment means and as herein illustrated, it is constituted by rigid foam blocks 25 and 25' which are interposed under the seating surface 18 of the seat 15 and a restraining means or box 26 secured to the inner face 16 of the bottom wall 27 of the kayak. The thickness of the blocks 25 and 25' will depend on the desired elevation of the seating surface, as above-described. The seat 15 may be formed with depending ribs 28 extending under the seating portion whereby to restrain the blocks 25 and 25'.

As shown in FIG. 5, the adjustment means is constituted by a linkage 30 comprising link arms 31 and 31' which are hingedly secured to the seat under the seating surface 18. The opposite ends of the link arms 31, 31' are pivotally secured to follower blocks 33 which are displaceable on an endless screw 34 which is rotated by a handle 35 or a ratchet receiving socket (not shown) whereby to cause rotation of the endless screw 34 and articulation of the follow arms 31 whereby to raise and lower the seating surface 18, as illustrated by arrow 36, to position the seating surface at the desired height above the inner surface 16 of the hull. Both height adjustment means shown, also offer the user the ability to raise the front of the seat more or less than the back of the seat, to accommodate differences in paddler build.

It is within the ambit of the present invention to cover any obvious modifications of the preferred embodiment described herein, provided such modifications fall within the scope of the appended claims.

I claim:

1. A kayak comprising a hull section and a deck section, an opening in said deck section to accommodate a user person, a seat positioned in said opening and secured on an inner wall of said hull section, and height adjustment means to position at least a portion of a seating surface of said seat at a desired elevation above a waterline of said kayak as determined when on a body of water, said desired elevation being dependent on the size of said kayak and its intended user person, said desired elevation providing the user person with greater force to manipulate sideways tilt and greater control of forward and backward pitch of said kayak during use and wherein said seat at said desired elevation lies in an elevated plane to transfer a load of said user person along opposed side vectors to apply pressure to opposed sides of said hull section below said waterline to achieve said sideways tilt, and along longitudinal vectors to apply pressure to opposed ends of said hull section to achieve said forward and backward pitch of said kayak.

2. A kayak as claimed in claim 1 wherein said height adjustment means is a variable height adjustment means in both up and down movement, and in seat tilt according to whether the seat or a back of said seat is raised more or less than the other.

3. A kayak as claimed in claim 2 wherein said variable height adjustment means is constituted by rigid foam blocks having a predetermined thickness depending on the desired position of said seating surface above said waterline.

4. A kayak as claimed in claim 3 wherein said variable height adjustment means is constituted by a linkage interconnected between said seat and a rigid frame secured to said inner wall of said hull, and hand operable means to operate said linkage and vary the height of said seating surface with respect to said waterline.

5. A kayak as claimed in claim 4 wherein said hand operable means is a handle secured to an end of a screw to which said linkage is secured to cause said linkage to articulate and thereby vary the height of said seating surface.

6. A kayak comprising a hull section and a deck section, an opening in said deck section to accommodate a user person, a seat positioned in said opening and secured on an inner wall of said hull section, and height adjustment means to position at least a portion of a seating surface of said seat at a desired elevation with respect to a waterline of said kayak as determined when on a body of water, said desired elevation being dependent on the size of said kayak and its intended user person, said desired elevation providing the user person with greater force to manipulate sideways tilt and greater control of forward and backward pitch of said kayak, during use and wherein said seat at said desired elevation lies in an elevated plane to transfer a load of said user person along opposed side vectors to apply pressure to opposed sides of said hull section below said waterline to achieve said sideways tilt, and along longitudinal vectors to apply pressure to opposed ends of said hull section to achieve said forward and backward pitch of said kayak.

7. A kayak as claimed in claim 6 wherein said height adjustment means is a variable height adjustment means in both up and down movement, and in seat tilt according to whether the seat or a back of said seat is raised more or less than the other.

8. A kayak as claimed in claim 7 wherein said variable height adjustment means is constituted by rigid foam blocks having a predetermined thickness depending on the desired position of said seating surface above said waterline.

9. A kayak as claimed in claim 8 wherein said variable height adjustment means is constituted by a linkage interconnected between said seat and a rigid frame secured to said inner wall of said hull, and hand operable means to operate said linkage and vary the height of said seating surface with respect to said waterline.

10. A kayak as claimed in claim 9 wherein said hand operable means is a handle secured to an end of an endless screw to which said linkage is secured to cause said linkage to articulate and thereby vary the height of said seating surface.

* * * * *